United States Patent [19]

Tomes, Jr.

[11] Patent Number: 4,720,009

[45] Date of Patent: Jan. 19, 1988

[54] WIRE IDENTIFICATION SLEEVE CONTAINER

[76] Inventor: Herbert Tomes, Jr., Rte. 3, Box 1160, Callahan, Fla. 32011

[21] Appl. No.: 898,629

[22] Filed: Aug. 21, 1986

[51] Int. Cl.[4] ..... B65D 73/02

[52] U.S. Cl. ..... 206/328; 206/382; 206/383; 206/45.2; 206/45.24

[58] Field of Search ..... 206/382, 383, 328, 45.2, 206/45.24

[56] References Cited

U.S. PATENT DOCUMENTS

| | | | |
|---|---|---|---|
| 197,592 | 11/1877 | Bleloch | 206/382 |
| 2,628,711 | 2/1953 | Flannery | 206/382 |
| 3,500,998 | 3/1970 | Sanders | 206/382 |
| 3,951,263 | 4/1976 | Vale | 206/382 |
| 4,210,239 | 7/1980 | Takahashi | 206/382 |

FOREIGN PATENT DOCUMENTS

| | | | |
|---|---|---|---|
| 512926 | 9/1939 | United Kingdom | 206/382 |

*Primary Examiner*—Joseph M. Moy
*Attorney, Agent, or Firm*—Arthur G. Yeager

[57] ABSTRACT

Portable booklike container comprising two covers joined to a spine, a rigid support bar on the inside of the cover near its bottom edge, a plurality of parallel spaced elongated thin spindles affixed to the support bar and extending upward terminating with free ends short of and adjacent to the top edge of the covers, and quick release fastening means to maintain the covers in a position closed upon each other.

14 Claims, 7 Drawing Figures

WIRE IDENTIFICATION SLEEVE CONTAINER

BACKGROUND OF THE INVENTION

In electrical wire systems connecting a large number of devices to a source of electric power, there is a need to identify each wire so that it may be connected to the proper terminals in accordance with wiring diagram. In simpler systems the use of different colored wires is normally adequate to assist the electrician in connecting the correct wire to the correct terminal. In complex systems color coding is not appropriate because there are far more independent circuits to assemble than there are distinguishable colors. In such complex systems the coding is accomplished by letters or numbers or both, and the selected code is applied to a wire by threading onto the wire one or more sleeves bearing the selected code. It is now a common practice to purchase coils of plastic sleeves, each coil being a series of individual sleeves easily detachable from the coil and each being imprinted with a number, a letter, or a combination of numbers or letters. Each coil may have about 1000 individual sleeves attached to form a single strand about 14 feet long wrapped on a reel. Therefore, if all possible numbers and letters are used a full supply involves 36 reels.

These sleeves were originaly applied to a wire by hand which was awkward and time consuming, particularly if the code involved several numbers and/or letters. These difficulties were multiplied if the electrician was working in a close area and needed to assembly several different codes. Carrying loose lengths of several strands of sleeves became necessary and has continued to be the normal procedure up to day. In my copending patent application Ser. No. 898,630 filed Aug. 21, 1987 there is disclosed a tool for conveniently applying such sleeves to a wire rather than by hand.

It is an object of this invention to provide a novel container for carrying a selection of wire identification sleeves. It is another object of this invention to provide a novel container for such sleeves that can be carried in the pocket. Still other objects will become apparent from the more detailed description which follows.

BRIEF SUMMARY OF THE INVENTION

This invention relates to a portable booklike container for wire identification sleeves comprising two covers each of which is joined to a spine along a fold line, each cover having a top edge perpendicular to said fold line, a bottom edge, perpendicular to said fold line, a side edge parallel to said fold line, an inside surface, and an outside surface, a support bar attached to said inside surface parallel to and adjacent to said bottom edge, a plurality of parallel elongated thin spindles each affixed to said support bar and extending parallel to said fold line to a free end adjacent said top edge, and means for fastening said covers together when folded upon each other with said outside surfaces exposed.

In specific embodiments of this invention the container has two or three sections which fold upon each other to close into a small wallet container, and are held closed by a "Velcro" fastener. In another embodiment an elongated tape is incorporated along the spine of the container and adapted to be fastened so as to bend the covers in a concave/convex manner to form its own standard with the spindles projecting upward for easy selection and removal of any identification sleeve.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
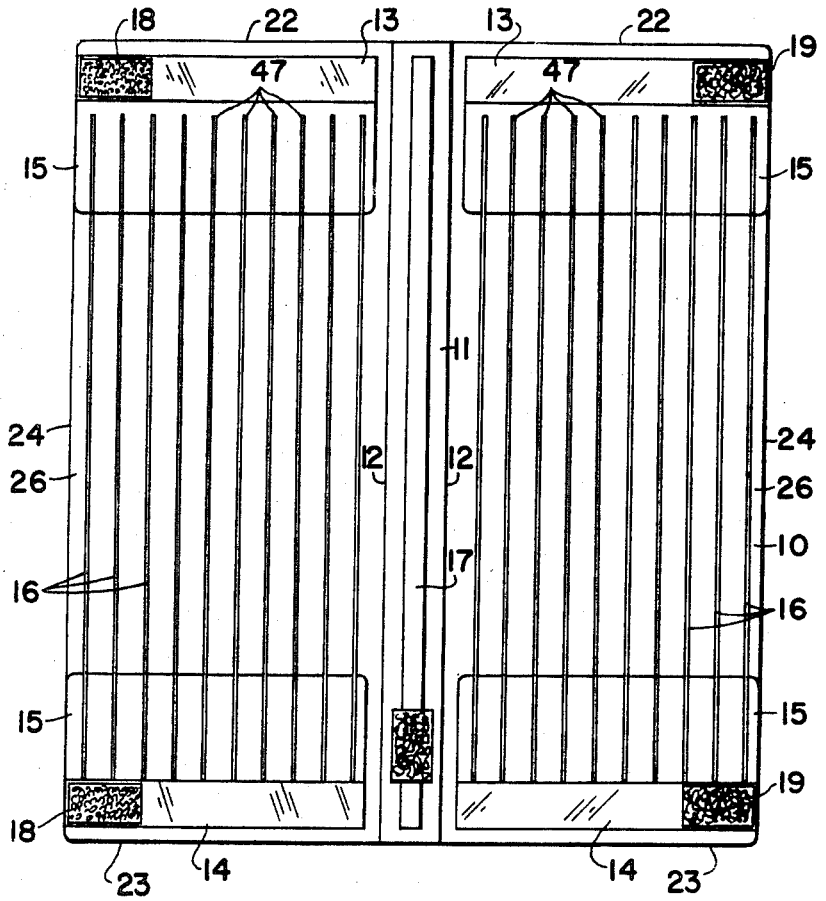
FIG. 1 is a top plan view of one embodiment of the container of this invention in an open position.
Figure 2:
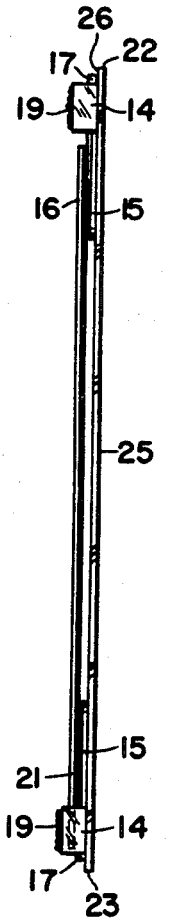
FIG. 2 is a side elevational view of the embodiment of FIG. 1.

The basic features of this invention can be seen in FIGS. 1–4 which illustrate one embodiment of the invention. The container is a foldable booklike article of two covers 10 joined to a spine 11 by two lengthwise parallel fold lines 12. Covers 10 and spine 12 are preferably a single piece of flexible sheet material similar to leather or plastic. Each cover 10 is rectangular having a top edge 22, a bottom edge 23, a side edge 24, an outside surface 25, and an inside surface 26. Spine 11 is a thin rectangular section having a top edge coinciding with top edges 22 of covers 10, and a bottom edge coinciding with bottom edges 23 of covers 10. Adjacent to bottom edge 23 on each cover 10 is affixed a support bar 14 generally extending across the entire width of cover 10. Each support bar 14 has affixed thereto a plurality of parallel elongated thin spindles 16 extending upward to free ends 47. Spindles 16 are small enough in diameter (e.g., 1–3 mm. or 0.04–0.12 inch) for identification sleeves 46 (see FIG. 4) to be easily slid on or off of spindles 16. It is convenient to employ 10 spindles 16 on each support bar 14 so that each spindle may carry a strand of sleeves 46 of the same number. In order to provide against inadvertent escape of the strands of sleeves 46 from spindles 16, an upper support bar 13 is affixed to inside surface 26 of each cover 10 adjacent top edge 22. Free ends 47 of spindles 16 are in close proximity to support bar 13 such that strands of sleeves 46 will not slide off spindles 16 when the container is closed as in FIG. 3 and carried in the pocket. Upper support bar 13 also serves to stiffen top edge 22 to make it self-standing (as in FIG. 4) and to assist in holding a fastener to keep the container closed. When support bars 13 and 14 are affixed to covers 10 by adhesives, as is the normal procedure, it is preferred to include short stiffener sheets 15 affixed to bars 13 and 14 to provide a larger area for adhesive contact.

Figure 3:
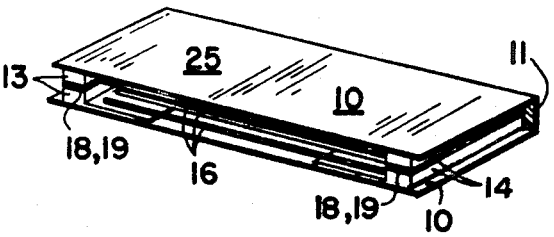
FIG. 3 is a perspective view of the container of FIG. 1 in a closed position.

The container is kept in a closed position as shown in FIG. 3 when not in use or when carried in the pocket of the electrician. Any type of quick release fastener may be employed, such as a snap or the like. It is preferred, because of convenience and ease of use to employ a "Velcro" fastener of fabric hooks and fabric loops. Patches of fabric hooks 18 and patches of fabric loops 19 are shown affixed to the outer ends of support bars 13 and 14 so as to engage each other when the container covers 10 are closed by folding upon each other.

Figure 4:
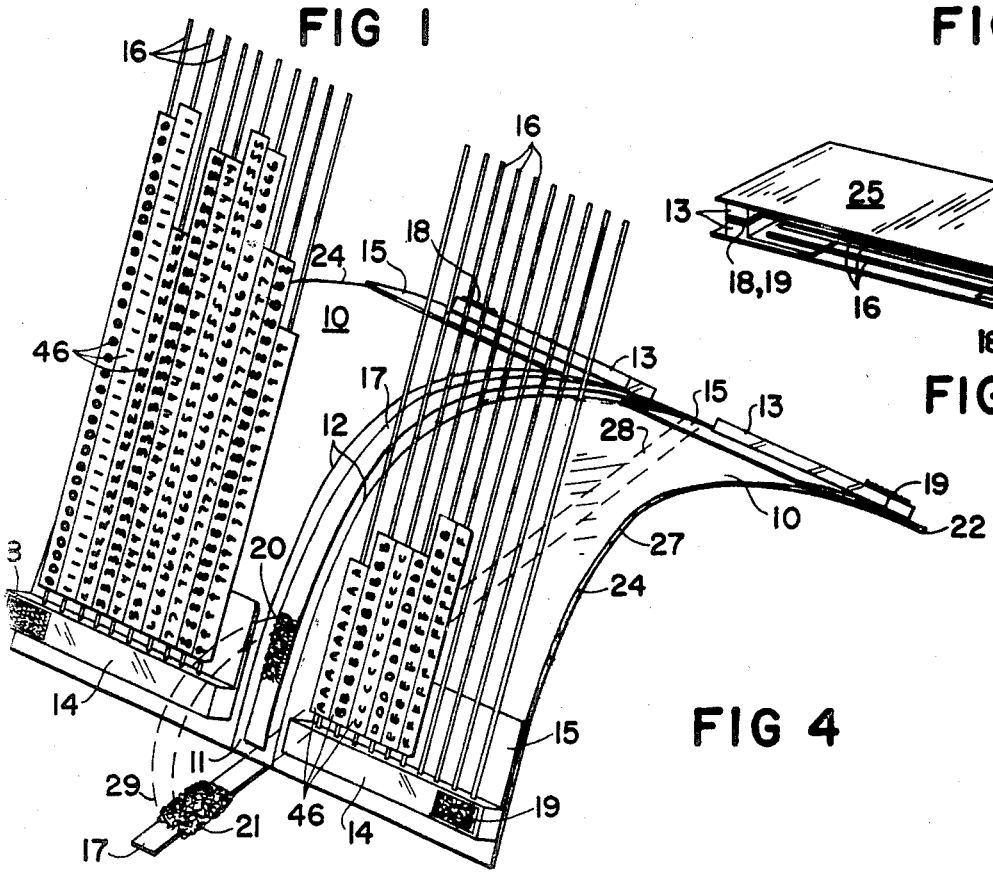
FIG. 4 is a perspective view of the container of FIG. 1 with sleeves on some of the spindles, and in the curved position for easy removal of sleeves.

In FIG. 4 the container is shown as it might be used by an electrician at a location where it is necessary to apply identification sleeves to wire. A tape 17, which is approximately twice as long as the length of the container (i.e., from top edge 22 to bottom edge 23), is affixed, as by stapling or attaching by an adhesive, to the inside surface of spine 11 and then doubled back upon itself so as to lie completely within covers 10 when not in use (see FIGS. 1–3). The loose length of tape 17 is held in place by a patch of fabric hooks 20 at the lower end of tape, where it is fastened to spine 11 near bottom edge 23, and its engagement with patch 21 of fabric loops attached to the other end (free end) of tape 17. When tape 17 is used to place the container in its operating position (see FIG. 4) the free length of the tape is pulled around outside surface 25 until covers 10 and spine 11 are bowed or curved with outside surface 25 forming a concave curve 27 and patch 21 can be attached to patch 20 by bending tape 17 as shown at 29. This position permits top edge 22 and bottom edge 23 to be able to rest on a flat surface, e.g., the floor, with spindles pointing upward and available for release of any selected sleeve 46.

Figure 5:
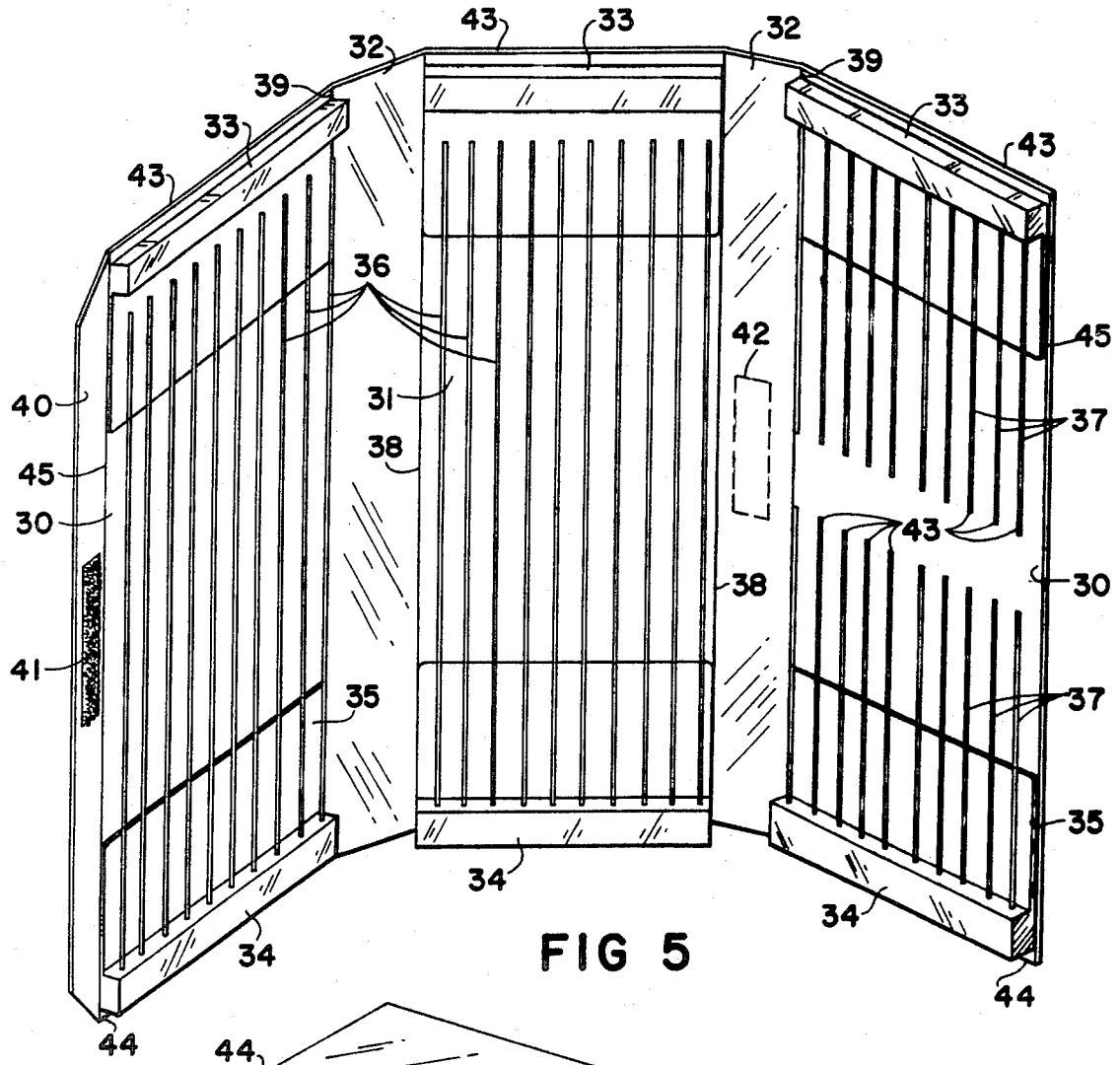
FIG. 5 is a perspective view of a second embodiment of the container of this invention in an open position.
Figure 6:
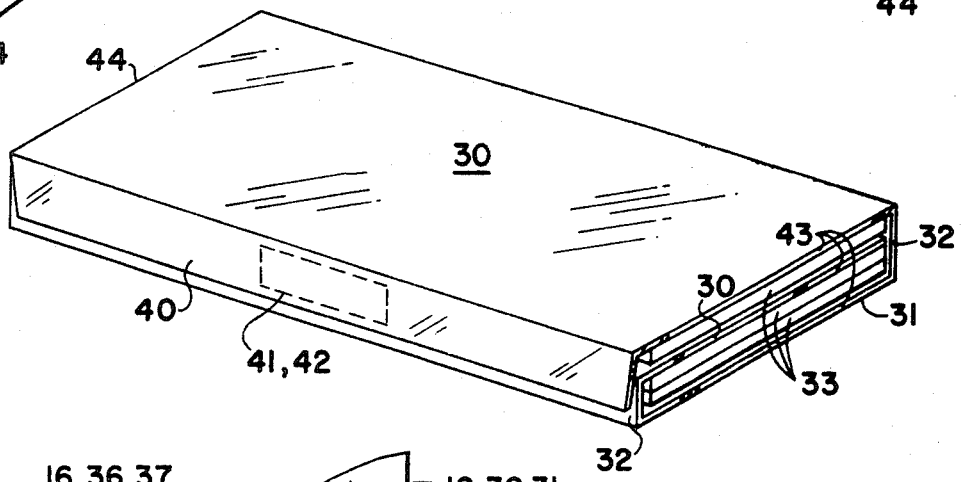
FIG. 6 is a perspective view of the container of FIG. 5 in a closed position.

In FIGS. 5–6, there is shown a second embodiment of the container which is larger than the embodiment of FIGS. 1–4. Here there are three interfolding covers; a central cover 31 and two outside covers 30 joined through two spines 32 with fold lines 38 connecting spines 32 to center cover 31 and fold lines 39 connecting spines 32 to outside covers 30. Upper support bars 33 and lower support bars 34 with stiffening sheets 35 are exactly the same as those described above with respect to FIGS. 1–4 and are attached to covers 30 and 31 in the same manner. Spindles 36 are shown for two covers while the third cover employs half-spindles 37 attached respectively to upper support bar 33 and lower support bar 34 with the free ends 48 pointing generally at the central portion of cover 30. This arrangement provides 20 long spindles 36 and 20 half-spindles 37. The capacity of this container is about 540 sleeves on long spindles 36 and about 240 sleeves on half-spindles 37. Such an arrangement is admirably suited to fill two long spindles 36 with each of the ten numbers (0–9) and to use the short spindles for 20 of the 26 letters.

The three-section container of FIG. 5 is folded twice upon itself to produce the closed structure of FIG. 6. In this instance it is preferred to add a flap 40 to one of side edges 45 of covers 30 with a patch 41 of fabric hooks attached. Patch 42 of fabric loops is attached to the outside of spine 32 to cooperate with patch 40 as shown in FIG. 6 to maintain this container in the closed position. If desired, one or two tapes, similar to tape 17 of FIGS. 1–4, may be employed along spines 32 to bend this container into the same operating position as that shown in FIG. 4.

Figure 7:
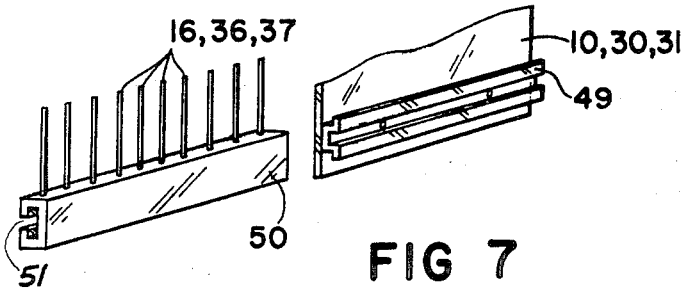
FIG. 7 is a perspective partial view of an alternative means for attaching spindles to the container.

In FIG. 7 there is shown an alternative structure for support bar 14 in FIG. 1 orsupport bars 33 and 34 in FIG. 5. In this alternative embodiment an attachment clip 49 is affixed to cover 10, 30, or 31 and the cooperating support bar 50 is made with a lengthwise grooved back side 51 which slides over clip 49. Support bar 50 carries spindles 16, 36, or 37 as required by the container. This embodiment makes it easier to load the spindles with the appropriate sleeves and also provides the convenience of having spare support bars 50 filled with sleeves ready to replace support bars 50 which have become exhausted of sleeves.

The above description refers specifically to encoding electric wires by the numbered or lettered sleeves carried in the container of this invention. It is to be understood that tubing or piping or other structures may be coded in order to identify them. Sleeves of different sizes may be needed for such tubing or piping and, accordingly, the container of this invention might be made considerably larger in order to accommodate a supply of such larger sleeves. Regardless of size or intended use these containers are intended to be within the scope of this invention.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what is desired to secure by Letters Patent of the United States is:

1. A portable booklike container for wire identification sleeves comprising two covers each of which is joined to a spine along a fold line each cover having a top edge perpendicular to said fold line, a bottom edge, perpendicular to said fold line, a side edge parallel to said fold line, an inside surface, and an outside surface, a support bar attached to said inside surface parallel to and adjacent to said bottom edge, a plurality of parallel elongated thin spindles each nonremovably affixed to said support bar and extending parallel to said fold line to a free end adjacent said top edge, and means for fastening said covers together when folded upon each other with said outside surfaces exposed.

2. The container of claim 1 wherein said means for fastening includes a cooperating pair of patches of fabric hooks and fabric loops.

3. The container of claim 1 said inside surface additionally contains a stiffening bar affixed to said inside surface adjacent said top edge.

4. The container of claim 1 wherein said covers are flexible sheets and said container additionally comprises an elongated tape affixed to said inside surface generally along said spine and having fastening means adapted to hold said container covers in an open position bent with said outside surfaces in a concave curve.

5. The container of claim 1 which comprises three covers joined to two spines by parallel fold lines, each said cover having a support bar and spindles as described in claim 1.

6. The container of claim 5 wherein one said cover has a support bar affixed to said inside surface adjacent each of said top edge and said bottom edge respectively, each said support bar of said one cover having a plurality of spaced elongated thin spindles affixed thereto and extending toward the opposite said support bar with free ends terminating short of the middle of said inside surface.

7. The container of claim 5 which additionally includes a closure flap along one of said side edges and a means for fastening said flap to said container with said covers folded upon each other.

8. A portable rectangular booklike container for wire identification sleeves comprising two covers each of which being joined to a spine along a fold line, each said cover having an inside surface, an outside surface, a top edge perpendicular to said fold line, a bottom edge perpendicular to said fold line, and a side edge parallel to said fold lines, each said cover having two parallel support bars affixed to the inside surface of said cover adjacent said top edge and said bottom edge respectively, a plurality of spaced parallel elongated thin spindles nonremovably affixed to said support bar adjacent said bottom edge and extending parallel to said fold lines to free ends adjacent said support bar adjacent said top edge, an elongated tape affixed to said inside surface along said spine and having quick release fastening means positioned to hold said container covers in a curved contour with said outside surface in a concave curve.

9. A portable rectangular booklike container for wire identification sleeves comprising three interfolding covers consisting of a center cover and two outside covers joined together by two spines connected to the adjacent cover by a fold line, two of said fold lines joining said center cover to each of said spines and two other fold lines joining said spines to said outside covers, each said cover having an inside surface, an outside surface, a top edge, and a bottom edge, and said two outside covers each also having a side edge; a support bar affixed to said inside surface of each of said covers adjacent to and parallel to each of said top edges and bottom edges, a plurality of parallel elongated thin spindles nonremovably fixed to each of said support bars adjacent said bottom edge and positioned parallel to said fold lines with free ends of said spindles extending toward said top edges, and a closure flap attached to one of said side edges with a quick release fastening means affixed to said flap to hold said folded container in a closed position.

10. The container of claim 9 wherein said fastening means consists of cooperating patches of fabric hooks and fabric loops.

11. The container of claim 1 wherein said support bar is removably attachable to said inside surface.

12. The container of claim 11 which additionally comprises an elongated clip attached to said inside surface parallel to and adjacent to said bottom edge, and said support bar is removably attachable to said clip.

13. The container of claim 9 wherein said support bar is removably attachable to said inside surface.

14. The container of claim 13 which additional comprises an elongated clip attached to said inside surface parallel to and adjacent to said bottom edges, and said support bar is removably attachable to said clip.

* * * * *